United States Patent [19]

Evenson

[11] Patent Number: 4,651,791

[45] Date of Patent: Mar. 24, 1987

[54] COLLAPSIBLE STRUCTURES PRIMARILY USEFUL AS WASTEBASKETS

[75] Inventor: Mel Evenson, San Pedro, Calif.

[73] Assignee: Eldon Industries, Inc., Inglewood, Calif.

[21] Appl. No.: 745,713

[22] Filed: Jun. 17, 1985

[51] Int. Cl.[4] ..... A45C 7/00

[52] U.S. Cl. ..... 150/50; 150/51; 150/55; 220/71; 229/4.5; 229/5.5; 229/41 R; 229/67

[58] Field of Search ..... 150/48, 50, 51, 55; 229/4.5, 5.5, 1.5 B, 21, 93, 41 R, 41 B; 220/66, 67, 72, 307, 71

[56] References Cited

U.S. PATENT DOCUMENTS

| | | | |
|---|---|---|---|
| 1,086,007 | 2/1914 | Wollitzer | 229/41 R |
| 1,096,453 | 5/1914 | Petterson | 229/21 |
| 1,246,947 | 11/1917 | Schott | 220/72 |
| 1,545,771 | 7/1925 | Hout | 229/41 B |
| 1,802,479 | 4/1931 | Robinson | 150/50 |
| 2,037,675 | 4/1936 | Boothby et al. | 229/41 R |
| 2,053,686 | 9/1936 | Powell et al. | 229/41 B |
| 2,089,084 | 8/1937 | Arneson | 229/41 B |
| 2,139,143 | 12/1938 | Wiswell | 220/72 |
| 2,226,178 | 12/1940 | Page | 229/41 B |
| 2,262,642 | 11/1941 | Liberson | 150/48 |
| 2,433,726 | 1/1948 | Sayre | 229/5.5 |
| 2,527,085 | 10/1950 | Snow | 220/72 |
| 2,620,006 | 12/1952 | Sorron-Zabala | 150/48 |
| 3,107,838 | 10/1963 | Brys et al. | 220/67 |
| 3,313,333 | 4/1967 | Lordi | 220/67 |
| 3,317,110 | 5/1967 | Palmer | 220/72 |
| 3,349,950 | 10/1967 | Wanderer | 229/1.5 B |
| 3,371,695 | 3/1968 | Lamb | 220/72 |
| 3,397,829 | 8/1968 | Wilkins | 229/41 B |
| 3,423,009 | 1/1969 | Palmer | 229/41 R |
| 3,747,830 | 7/1973 | Goldman | 229/41 B |
| 3,923,233 | 12/1975 | Smith | 229/21 |
| 4,136,705 | 1/1979 | Kulpa | 229/41 B |
| 4,428,500 | 1/1984 | Kohler | 220/462 |

FOREIGN PATENT DOCUMENTS

| | | | |
|---|---|---|---|
| 1056730 | 3/1954 | France | 229/21 |
| 53490 | 1/1934 | Norway | 229/4.5 |
| 15314 | of 1907 | United Kingdom | 229/4.5 |
| 1366310 | 9/1974 | United Kingdom | 229/1.5 B |

*Primary Examiner*—William Price
*Assistant Examiner*—Gary E. Elkins
*Attorney, Agent, or Firm*—Edward D. O'Brian

[57] ABSTRACT

A collapsible container primarily useful as a wastebasket can be constructed utilizing a flexible, tubular vertically oriented peripheral wall reinforced by vertically extending stiffeners and a rigid bottom fitting within the peripheral wall in order to hold it in a normal open configuration. The bottom wall is capable of being positioned in and of being removed from the peripheral wall. In the absence of the bottom wall in the peripheral wall the peripheral wall may be collapsed.

13 Claims, 9 Drawing Figures

FIG. 1.
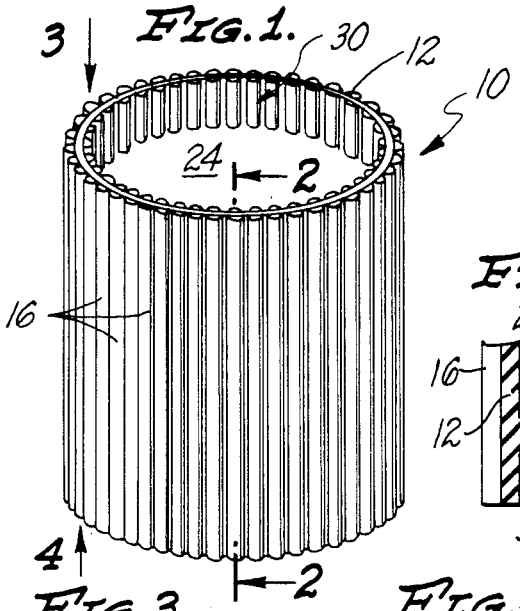
FIG. 2.
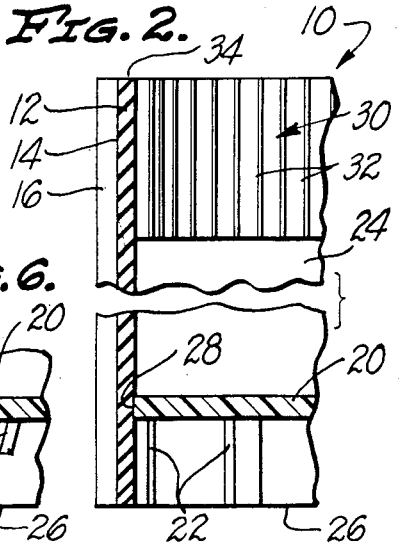
FIG. 6.
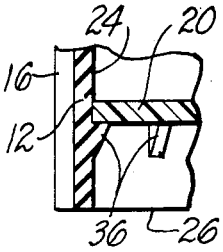
FIG. 3.
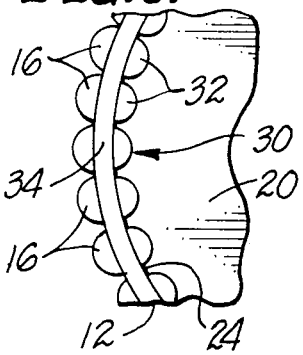
FIG. 4.
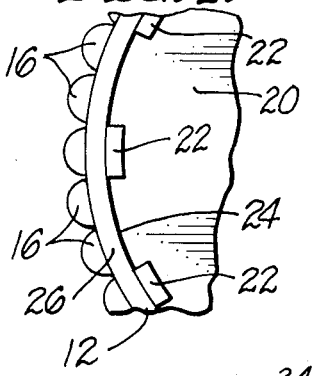
FIG. 5.
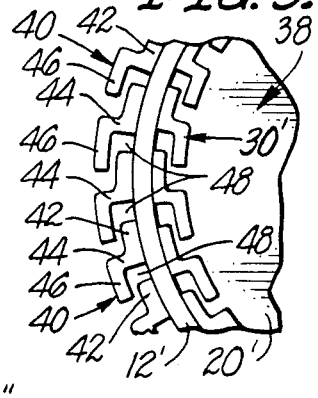
FIG. 7.
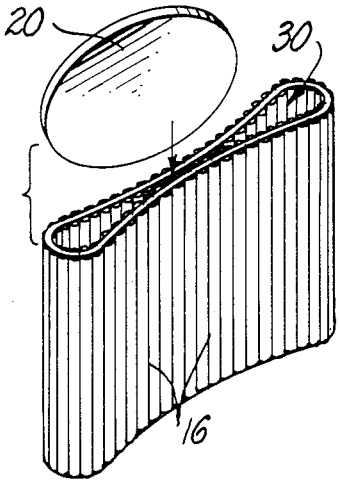
FIG. 8.
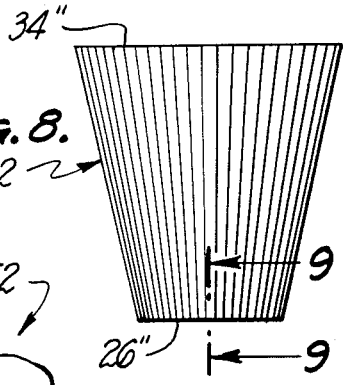
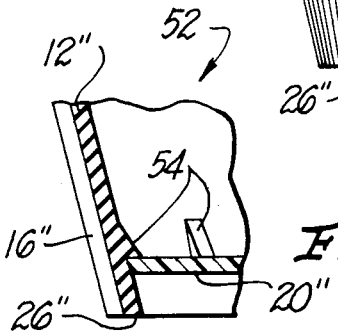
FIG. 9.

COLLAPSIBLE STRUCTURES PRIMARILY USEFUL AS WASTEBASKETS

BACKGROUND OF THE INVENTION

This invention pertains to new and improved collapsible containers which are primarily useful as wastebaskets.

Because of economic considerations which are unimportant to an understanding of the present invention many different types of collapsible containers have been developed for various different specific purposes. In spite of the amount of work which has been devoted to the devleopment of various types of collapsible containers, it is considered that a need still exists for collapsible containers which are constructed so that they are specifically adapted for use as wastebaskets.

Of course, many different types of prior collapsible containers which have not been developed specifically for such use are capable of being utilized as wastebaskets. However, it is considered that known collapsible containers capable of being used as wastebaskets are not particularly desirable for such use for any of a variety of different reasons. Frequently, such prior structures are relatively difficult to assemble and disassemble. Many of such prior structures are of such a character that they do not present a pleasing, aesthetic appearance or cannot be adapted to present a desired type of aesthetic appearance making them especially useful with other items having a common design motif. Further, certain of such prior collapsible containers are considered to be unneccesarily complex and/or expensive.

SUMMARY OF THE INVENTION

This invention is intended to fulfill the need indicated in the preceding discussion for new and improved collapsible containers which are primarily useful as wastebaskets. More specifically, this invention is intended to provide collapsible containers having such utility which may be easily assembled and disassembled, which can be modified in accordance with industrial design skill to have a desired aesthetic appearance and which may be easily constructed at a comparatively nominal cost.

In accordance with this invention, these various objectives are acheived by providing in a collapsible container having a vertically oriented peripheral wall and a bottom wall closing off the interior of the bottom of said peripheral wall the improvement which comprises: said peripheral wall being an endless wall formed of a flexible material which is sufficiently flexible so that said peripheral wall can be manipulated between a normal configuration in which the interior is opened up to as great an extent as possible and a collapsed configuration in which the interior of said peripheral wall is closed off, a plurality of vertically extending stiffeners located adjacent to one another on the exterior of said peripheral wall, said stiffeners being spaced from one another to a sufficient extent so as to permit said peripheral wall to be deformed from said normal to said collapsed configuration, and a plurality of supports located on the interior of said peripheral wall adjacent to the bottom thereof, said supports being spaced from one another so as to be capable of holding said bottom wall so that it is horizontally oriented and so as to be incapable of interfering with the manipulation of said peripheral wall between said normal and said collapsed configurations when said bottom wall is not located on said supports, said bottom wall fitting against said supports within said peripheral wall when in a normal position so as to reinforce said peripheral wall against being manipulated from said normal to said collapsed configuration, said bottom wall being capable of being removed from said supports so as to permit said peripheral wall to be manipulated from said normal to said collapsed configuration.

DESCRIPTION OF THE DRAWINGS

Because of the nature of this invention, it is considered that it is best more fully described with reference to the accompanying drawings in which:

FIG. 1 is a diagrammatic, isometric view of a presently preferrred embodiment of a collapsible container of the present invention which is primarily useful as a wastebasket;

FIG. 2 is a partial cross sectional view taken at line 2—2 of FIG. 1 at an enlarged scale;

FIG. 3 is a partial top plan view taken in the direction of the arrow 3 in FIG. 1 at an enlarged scale;

FIG. 4 is a partial bottom plan view taken in the direction of the arrow 4 in FIG. 3 at an enlarged scale;

FIG. 5 is a view corresponding to FIG. 3 of a modified construction of the present invention;

FIG. 6 is a view corresponding to part of FIG. 2 of a further modified construction in accordance with this invention;

FIG. 7 is a diagrammatic view indicating how a container as shown in FIG. 1 can be collapsed while being shipped or handled;

FIG. 8 is a view corresponding to FIG. 1 of a still further modified container in accordance with the present invention; and FIG. 9 is a partial cross sectional view corresponding to FIG. 6 taken at line 9—9 of FIG. 8 at an enlarged scale.

The accompanying drawing is not intended to illustrate any precise structure drawn to scale. Instead, it is intended to illustrate structures embodying the concepts or principles of this invention as are set forth and defined in the appended claims. These concepts or principles can be utilized in various differently appearing containers through the exercise of routine industrial design skill.

DETAILED DESCRIPTION

In the drawing there is shown a collapsible container 10 which is primarily useful as a wastebasket. This container 10 includes a normally vertically oriented, flexible peripheral wall 12. This wall 12 is essentially an endless band which may be formed out of any easily deformed material such as rubber, a nylon fabric suitable for use in luggage and backpacks, a conventional canvass or the like. If desired, this wall 12 may be of a fabric reinforced with or laminated to natural or snythetic rubber.

On the exterior 14 of the wall 12 a plurality of vertically extending, parallel stiffeners 16 are positioned in a manner as is best seen in FIGS. 3 and 4 of the drawings. These stiffeners 16 are preferably formed of a metal or a rigid polymer so as to be sufficently stiff as to be resistant to bending and so as to have a uniform cross-sectional configuration throughout their lengths. These stiffeners 16 are preferably secured to the exterior 14 of the wall 12 in any convenient manner such as, for example, through the use of appropriate adhesive (not shown because of the small dimensions of the adhesive) so as to be located adjacent one another and yet so as to be spaced from one another a sufficient extent so as to permit the peripheral wall 12 to be manipulated from a normal configuration as shown in FIG. 1 to a collapsed configuration as diagrammatically illustrated in FIG. 7.

When the peripheral wall 12 is in its normal configuration it is reinforced against being collapsed by a circular, disc-like bottom wall 20. This bottom wall 20 is held by gravity against supports 22 which may be formed by material such as is used in connection with the stiffeners 16 and which are secured to the interior 24 of the wall 12 in the same manner in which the stiffeners 16 are secured in place. The supports 22 are located adjacent to the bottom 26 of the wall 12 so as to hold the wall 20 by gravity and to space the bottom wall 20 a short distance upwardly from the bottom 26. In order to serve its intended function, the bottom wall 20 must of course be formed of a comparatively rigid material.

Preferably, the peripheral wall 12 is formed of a resilient, somewhat stetchable material, such as a natural or artificial rubber with or without reinforcing fibers within the rubber. When the wall 12 is formed of such material, the bottom wall 20 can be formed so that its periphery 28 is slightly larger than the periphery (not separately numbered) of the interior 24 of the wall 12. This is to enable the peripheral wall 12 to resiliently engage the bottom wall 20 in order to firmly hold it in place.

One advantage of the container 10 relates to the fact that this bottom wall 20 may be formed so as to have an oval shape or even the shape of a polygon. This will enable a single peripheral wall 12 to be used in supplying wastebaskets or containers having a plurality of exterior shapes.

If desired, the container 10 may include a band 30 of short, decorative strips 32 corresponding to the stiffeners 16 located adjacent to the top 34 of the wall 12. These strips 32 can be formed of the same material as the stiffeners 16 and may be secured in place in the same manner in which the stiffeners 16 are secured in place. If desired, such a band 30 can be substituted for the supports 22 previously described. It is also possible to substitute for the supports 22 small ratchet-like holders 36 for the previously described supports 22. These holders 36 may be formed integrally with the wall 12 whereas the supports 22 are separate elements attached to it.

It is also possible to modify the stiffeners 16 as may be desired for various aesthetic reasons. A structure of this type is indicated in FIG. 5. For convenience, various parts shown in FIG. 5 are designated with the primes of the numerals previously used to designate such parts. Unless specifically indicated herein, this structure 38 is identical with the container 10.

In the structure 38 the previously described stiffeners 16 are replaced by other stiffeners 40 which differ from the stiffeners 16 only in appearance. These stiffeners 40 have bases 42 attached to the peripheral wall 12' and small offsets 44 connected to covering walls 46. For convenience these stiffeners 40 are preferably of uniform cross sectional configuration throughout their lengths, The described structure permits the covering walls 46 to overlay spaces 48 between the stiffeners 40 so as to hide the peripheral wall 12' from view. If desired, a band 30' of other stiffeners 40 corresponding to the strips 32 in function and corresponding to the stiffeners 40 in appearance can be used.

Although normally the peripheral wall 12 used in any container in accordance with this invention will be a cylindrical wall, it is possible to utilize a peripheral wall which is in the shape of a frustrum of a right circular cone. This is indicated in connection with a modified container 52 illustrated in FIGS. 8 and 9 of the drawings. Since this container 52 is essentially the same as the container 10 in construction only those aspects of the container 52 which are specifically different from the container 10 are separately described herein and all the parts of the container 52 which reasonably correspond to parts in the container 10 are not separately described but are designated by the double primes of the numbers previously used to designate such parts.

In the container 52 the peripheral wall 12" is shaped as indicated in the preceding discussion. As a result of this change, it is considered desirable—but not neccesary—to change the configuration of the stiffeners 16 so that they are non uniform in their cross sectional configuration throughout their lengths and so that they are of a trapazoidal configuration so as to be larger adjacent to the top 34" than the bottom 26" of the wall 12".

Because of the shape of the wall 12" of the container 52 normally elements corresponding to the supports 22 or the holders 36 will not be needed, although, if desired, they may be used. Instead, it will normally be preferable to utilize holders 54 which correspond to the holders 36 in all respects except for the fact that they are oriented so as to hold the bottom 26" down instead of supporting it through the action of gravity.

I claim:

1. A collapsible structure having a vertically oriented peripheral wall and a bottom wall closing off the interior of the bottom of said peripheral wall the improvement which comprises:

said peripheral wall being an endless wall formed of a flexible material which is sufficiently flexible so that said peripheral wall can be manipulated between a normal configuration in which the interior is opened up to as great an extent as possible and a collapsed, substantially flat configuration in which the interior of said peripheral wall is closed off, a plurality of vertically extending closely spaced, substantially parallel stiffeners located adjacent to one another on the exterior of said peripheral wall and attached to said peripheral wall, said stiffeners being spaced from one another only to a sufficient extent so as to permit said peripheral wall to be deformed from said normal to said collapsed configuration, and a plurality of supports located on the interior of said peripheral wall adjacent to the bottom thereof, said supports being spaced from one another so as to be capable of holding said bottom wall so that it is horizontally oriented and so as to be incapable of interfering with the manipulation of said peripheral wall between said normal and said collapsed configurations when said bottom wall is not located on said supports, said bottom wall fitting against said supports within said peripheral wall when in a normal position so as to reinforce said peripheral wall against being manipulated from a normal to a collapsed configuration, said bottom wall being capable of being removed from said supports so as to permit said peripheral wall to be manipulated from said normal to said collapsed configuration.

2. A collapsible structure as claimed in claim 1 wherein:

said structure is a container, said peripheral wall is capable of being manipulated so as to be cylindrical when it is in a normal configuration.

3. A collapsible container as claimed in claim 2 wherein:

said stiffeners have a uniform cross sectional configuration throughout their lengths and extend from the top to the bottom of said collapsible container when said peripheral wall is in said normal configuration.

4. A collapsible container as claimed in claim 1 wherein:

said stiffeners are shaped so as to overlay the spaces between said stiffeners along said peripheral wall so as to hide said peripheral wall from view when said peripheral wall is in said normal configuration.

5. A collapsible container as claimed in claim 3 wherein:

said peripheral wall is of a resilient character and said bottom wall fits within said peripheral wall so as to be resiliently engaged with said peripheral wall.

6. A collapsible container as claimed in claim 2 including:

a band of decorative strips corresponding to said stiffeners located adjacent the top of said peripheral wall and extending around the interior of said peripheral wall.

7. A collapsible structure as claimed in claim 1 wherein:

said structure is a container, said peripheral wall is capable of being manipulated so as to be cylindrical when it is in a normal configuration, said stiffeners have a uniform cross sectional configuration throughout their lengths and extend from the top to the bottom of said collapsible container when said peripheral wall is in said normal configuration, said peripheral wall is of a resilient character and said bottom wall fits within said peripheral wall so as to be resiliently engaged with said peripheral wall.

8. A collapsible container as claimed in claim 7 wherein:

said stiffeners are shaped so as to overlay the spaces between said stiffeners along said peripheral wall so as to hide said peripheral wall from view when said peripheral wall is in said normal configuration.

9. A collapsible container as claimed in claim 2 including:

a band of decorative strips corresponding to said stiffeners located adjacent the top of said peripheral wall and extending around the interior of said peripheral wall.

10. A collapsible container as claimed in claim 7 wherein:

said stiffeners are shaped so as to overlay the spaces between said stiffeners along said peripheral wall so as to hide said peripheral wall from view when said peripheral wall is in said normal configuration, a band of decorative strips corresponding to said stiffeners located adjacent the top of said peripheral wall and extending around the interior of said peripheral wall.

11. A collapsible structure having a vertically oriented peripheral wall and a bottom wall closing off the interior of the bottom of said peripheral wall the improvement which comprises:

said peripheral wall being an endless wall formed of a flexible material which is sufficiently flexible so that said peripheral wall can be manipulated between a normal configuration in which the interior is opened up to as great an extent as possible and in which said peripheral wall has the shape of a frustrum of a right circular cone and a collapsed, substantial flat configuration in which the interior of said peripheral wall is closed off, a plurality of vertically extending closely spaced, substantially parallel stiffeners located adjacent to one another on the exterior of said peripheral wall and attached to said peripheral wall, said stiffeners being spaced from one another only to a sufficient extent so as to permit said peripheral wall to be deformed from said normal to said collapsed configuration, and a plurality of supports located on the interior of said peripheral wall adjacent to the bottom thereof, and supports being spaced from one another (1) so as to be capable of holding said bottom wall so that it is horizontally oriented and (2) so as to be incapable of interfering with the manipulation of said peripheral wall between said normal and said collapsed configurations when said bottom wall is not located on said supports, said bottom wall fitting against said supports within said peripheral wall when in a normal position so as to reinforce said peripheral wall against being manipulated from a normal to a collapsed configuration, said bottom wall being capable of being removed from said supports so as to permit said peripheral wall to be manipulated from said normal to said collapsed configuration.

12. A collapsible container as claimed in claim 11 wherein:

said stiffeners extend from the top to the bottom of said container when said peripheral wall is in said normal configuration and are larger adjacent to said top then adjacent to said bottom.

13. A collapsible container as claimed in claim 7 wherein:

said peripheral wall is of a resilient character and said bottom wall fits within said peripheral wall so as to be resiliently engaged with said peripheral wall.

* * * * *